United States Patent [19]

Senba

[11] Patent Number: 4,570,556

[45] Date of Patent: Feb. 18, 1986

[54] AUTOMATIC SEAMING METHOD AND APPARATUS FOR GORED PANTY-HOSES

[75] Inventor: Rikichi Senba, Osaka, Japan

[73] Assignee: Senba Machinery Co. Ltd., Japan

[21] Appl. No.: 130,850

[22] Filed: Mar. 17, 1980

[30] Foreign Application Priority Data

Mar. 16, 1979 [JP] Japan ..... 54-031570

[51] Int. Cl.[4] ..... D05B 21/00; D05B 3/12

[52] U.S. Cl. ..... 112/121.15; 112/121.26; 112/121.29; 112/104

[58] Field of Search ..... 112/121.15, 121.11, 112/121.12, 121.29, 121.26, 104; 2/407, 408, 409

[56] References Cited

U.S. PATENT DOCUMENTS 4,220,104 9/1980 Humphreys ..... 112/121.15 X

FOREIGN PATENT DOCUMENTS 462086 6/1978 Spain ..... 112/121.15

2029195 3/1980 United Kingdom ..... 112/121.15

*Primary Examiner*—H. Hampton Hunter

*Attorney, Agent, or Firm*—Lerner, David, Littenberg, Krumholz & Mentlik

[57] ABSTRACT

Automatic seaming of gore pieces to respective incomplete panty-hoses while four sets of suction assembly travel in an intermittent fashion from station to station along a prescribed circular path of travel in order to produce gored panty-hoses, different automatic operations being almost concurrently carried out at different stations. Products of uniform quality are produced with minimal manual labor, simple construction, reduced power consumption and high production efficiency.

11 Claims, 17 Drawing Figures

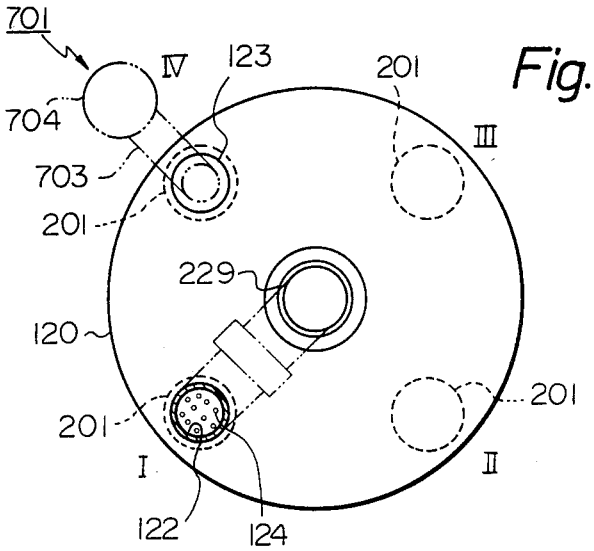
Fig. 6
Fig. 8
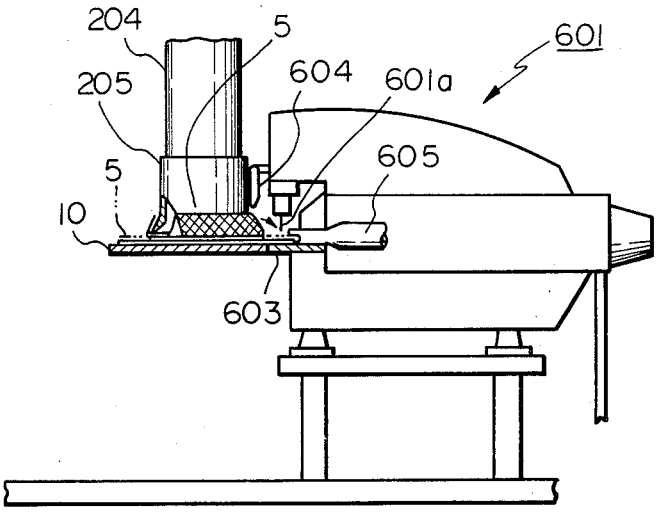

AUTOMATIC SEAMING METHOD AND APPARATUS FOR GORED PANTY-HOSES

BACKGROUND OF THE INVENTION

The present invention relates to improved method and apparatus for automatically seaming a gore piece to the inside thigh section of a panty-hose, and more particularly relates to improvement in the system for seaming a gore piece to the inside thigh section of a panty-hose in an almost automatic fashion.

The conventional system for producing a gored panty-hose in general two-staged seaming operations. In the first stage, two leg sections and a panty section are seamed together by the so-called skip seaming whilst leaving an unseamed opening in the inside thigh section of an incomplete panty-hose. Next in the second stage, a separate gore piece is fitted to the above-described thigh section opening and its fringe is seamed to the unseamed sliced fringe of the thigh section, which defined the opening, in order to form a complete panty-hose.

Due to the complicated form of the seaming line for coupling of the gore piece with the sliced fringe on the inside thigh section, the second staged seaming operation is extremely complicated and difficult to practice successfully.

For this reason, the seaming of the gore piece has conventionally depended upon manual operation by expert operators. This naturally causes low productivity of the second stage seaming operation, increased human labour and resultant high increase in the production cost of gored panty-hoses.

In addition, it is very difficult even for a single operator to constantly seam a gore piece to the correct position in the thigh section in a correct manner since the seaming is dependent upon manual operation. This connects to inter-products variance in quality of panty-hoses so produced. When different panty-hoses are produced by different operators, the variance is further amplified since the inter-products variance is accompanied with inter-operators variance. Thus, in the conventional production of gore panty-hoses, one cannot expect uniform quality of the products.

In order to avoid this advantage, a number of automatic seaming systems for gored panty-hoses have been proposed. Due to the unavoidable presence of the above-described complicated seaming line, however, one cannot expect reliable operations of the apparatuses for practicing such automatic seaming systems. In order to obtain high reliability in operation, one needs to adopt an extremely complicated design for such an apparatus. Thus, it is the state of the art that none of the conventionally proposed systems has been able to carry out the second stage automatic seaming operation with appreciably sufficient results.

SUMMARY OF THE INVENTION

It is the basic object of the present invention to enable almost automatic seaming of a gore piece to the thigh section of an incomplete panty-hose at remarkably high production efficiency.

It is another object of the present invention to produce gored panty-hoses with low production cost and extremely small inter-products variance in quality.

It is the other object of the present invention to provide an automatic apparatus of a simple construction and capable of carrying out the above-described second stage seaming operation with high reliability in operation.

In accordance with the basic aspect of the present invention, an incomplete panty-hose prepared in the first stage seaming operation is sucked into a pneumatic suction tube and held in the pipe by assistance of hooks arranged within the pipe. Concurrently with this suction, the sliced fringe of the thigh section opening is folded over the outer surface of the open end of the suction tube. Keeping this disposition, pneumatic suction in the suction tube is intercepted and the suction tube with the incomplete panty-hose is brough to a gore piece transfer station. Heat cutting is applied to the folded sliced fringe in order to obtain one or more cuts in the sliced fringe. A gore piece cut into a prescribed shape by a gore piece feeder assembly is passed to a gore piece transfer assembly which in turn fits the gore piece to the correct position on the incomplete panty-hose held by the suction tube. Next, the folded sliced edge is put into a horizontal state in order to be superimposed on the fringe of the gored piece. Keeping this superimposed disposition, the suction tube with the incomplete panty-hose and the gore piece is then brought to a seaming station where a sewing machine is arranged. The second stage seaming is carried out by the sewing machine while the suction tube is rotated. During subsequent travel of the suction tube with a seamed panty-hose, the complete panty-hose is removed out of the system via the suction tube by resumption of the pneumatic suction.

BRIEF DESCRIPTION OF THE DRAWINGS

FIG. 6 is a section taken along a line X—X in FIG. 5, FIG. 8 is a side view, partly in section, of the seaming machine and its related parts used for the seaming apparatus shown in FIG. 3, FIGS. 9A through 9D are perspective views for showing the sequential operational steps of the seaming method in accordance with the present invention.

DESCRIPTION OF THE PREFERRED EMBODIMENT

Figure 1:
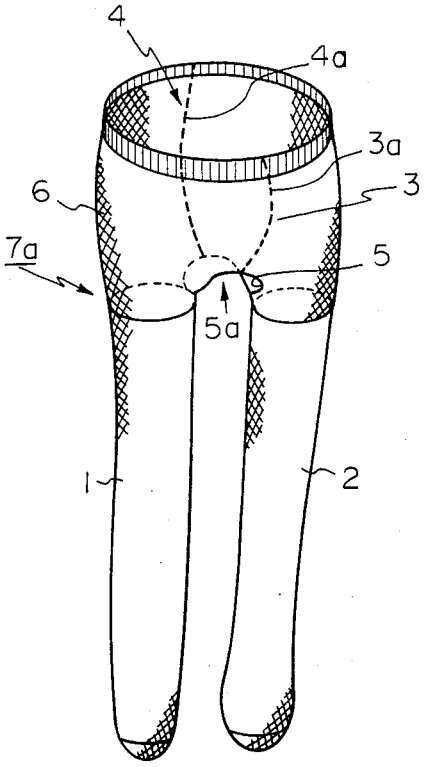
FIG. 1 is a perspective view of an incomplete panty-hose having an inside thigh opening.

One typical exmaple of the process for producing a gored panty-hose will hereinafter explained briefly in reference to FIGS. 1 and 2. The process includes dual-staged seaming operations. A pair of cylindrical stocking materials 1 and 2, each closed at the toe end, of same size are superposection in the section forming the panty section 6 and the thigh section is sliced. Next, the first seaming operation is applied to the superposed stocking materials in order to obtain an incomplete panty-hose 7*a* such as shown in FIG. 1. The front and rear side sliced fringes 3 and 4 are seamed together along seam lines 3*a* and 4*a* whilst leaving a sliced fringe 5 in the inside thigh section unseamed. The incomplete panty-hose thus includes an unseamed opening 5*a* in the inside thigh section.

This sort of so-called skip seaming operation can easily be carried out on a known line close such as the one disclosed in Japanese Pat. No. 880,791.

Figure 2:
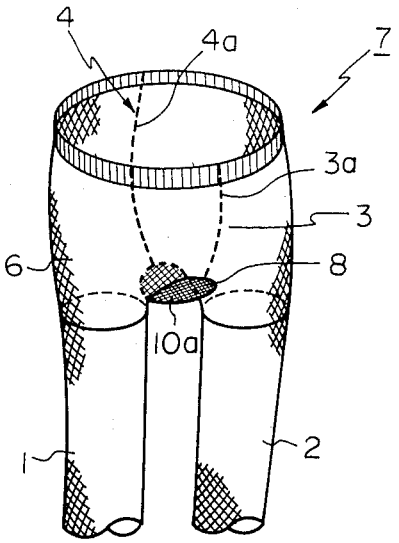
FIG. 2 is a perspective view of a complete panty-hose with a gore piece seamed to its inside thigh.

In the second stage seaming operation, a gore piece 10 is fitted to the above-described unseamed opening 5*a* in the incomplete panty-hose 7*a*, and the sliced fringe 5 in the inside thigh section and the fringe of the gore piece 10 are seamed together along a seaming line 8 in order to form a complete gored panty-hose such as shown in FIG. 2.

Figure 3:
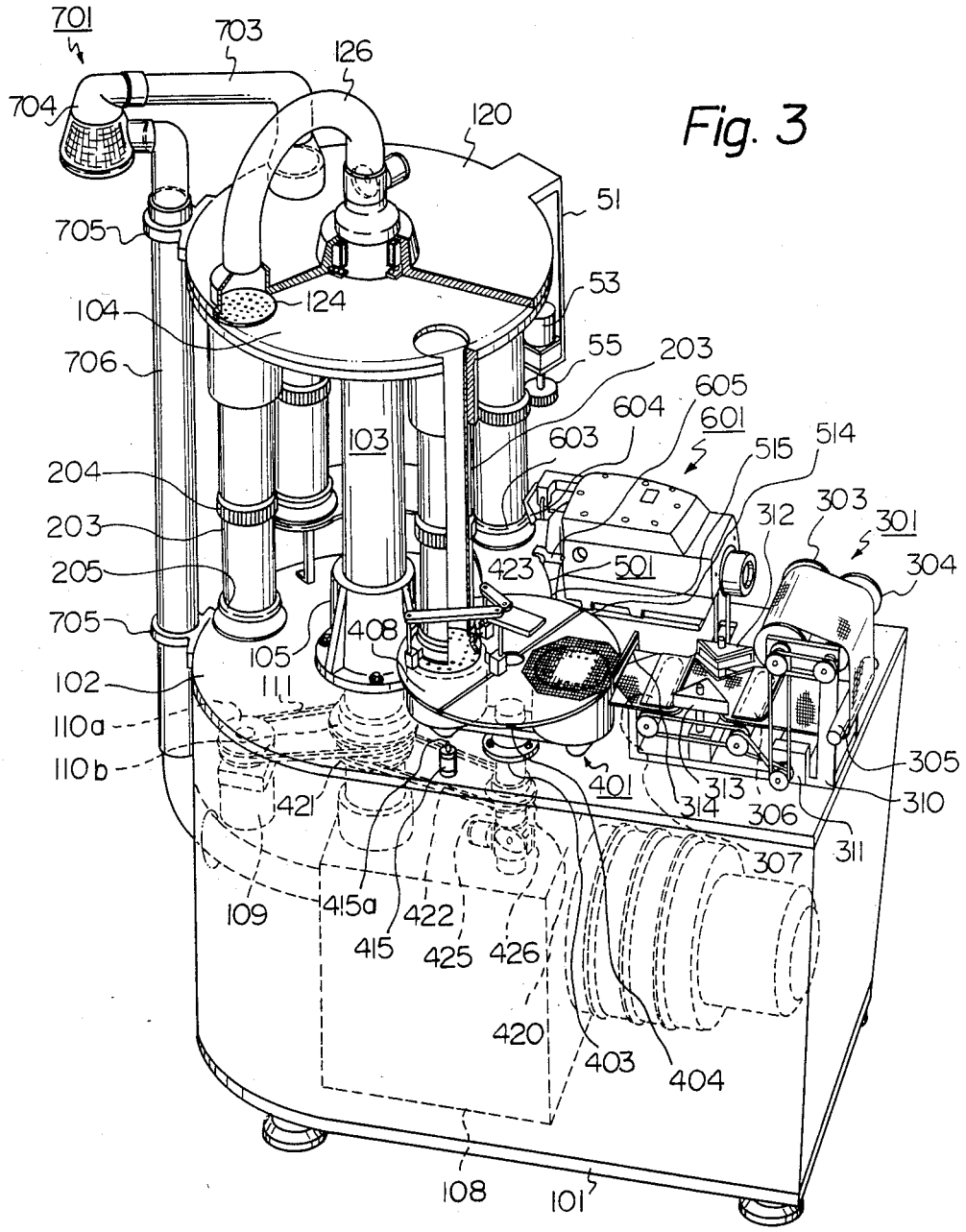
FIG. 3 is a perspective view, partly removed for easy understanding, of one embodiment of the seaming apparatus in accordance with the present invention.
Figure 4:
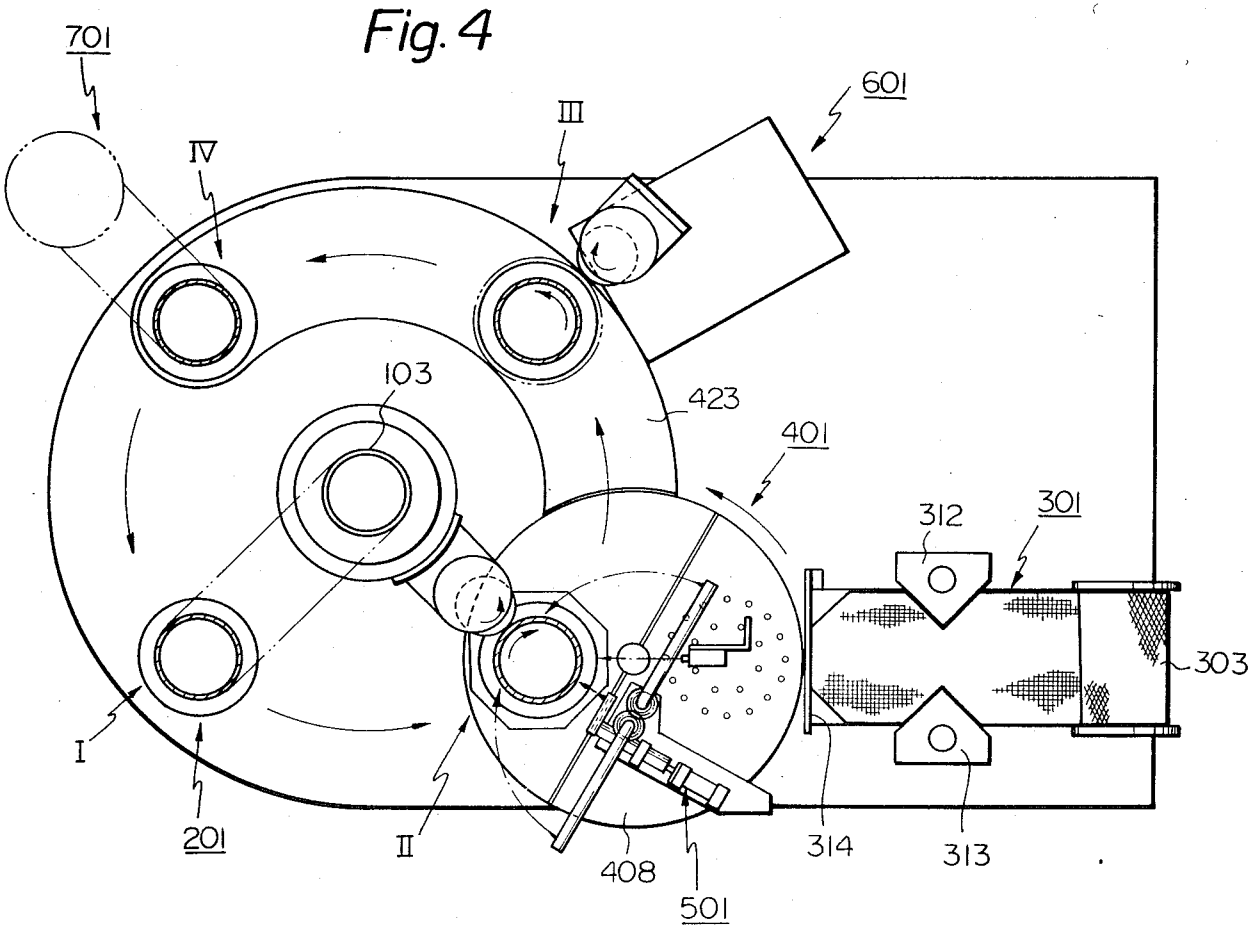
FIG. 4 is a plan view of the seaming apparatus shown in FIG. 3.

One embodiment of the seaming apparatus in accordance with the present invention is shown in FIGS. 3 and 4.

An operation table 102 is mounted atop a pedestal casing 101 and both are made up of semi-circular sections and integral square sections. An upwardly extending vertical shaft 103 is rotatably arranged about the center of the semi-circular section of the operation table 102 and a carrier disc 104 is horizontally mounted atop the main shaft 103. As shown in FIG. 3, four sets of downwardly extending suction assemblies 201 are disposed to the carrier disc 104 at equal intervals along its periphery. The number of the suction assemblies 201 is unlimited to four sets and can be chosen as desired in accordance with requirement in practice. The suction assemblies 201 revolve, together with the carried disc 104, about the axis of the main shaft 103 in the counter-clockwise direction in the illustration in order to travel from the first to fourth operation stations I to IV provided on the operation table 102.

In the first station I, an incomplete panty-hose 7*a* having an inside thigh opening 5*a* (see FIG. 1) is manually attached to one suction assembly 201 in that station. The leg sections are pneumatically sucked into the suction tube 203 while the sliced fringe 5 is folded over the outer surface of the lower end of the suction tube 203. Then the pneumatic suction acting on the suction assembly 201 is intercepted by suitable manual switching. As later described in more detail, hooks arranged in the suction tube 203 hold the sucked incomplete panty-hose within the suction tube 203 even after the pneumatic suction is provisionally cancelled.

In the second station II, a gore piece 10 cut into a prescribed shape is passed to a gore piece transfer assembly 401 by a gore piece feeder assembly 301. Concurrently with this transfer of the gore piece 10, adequate number of cuts are formed in the section of the sliced fringe 5 folded over the outer surface of the lower end of the suction tube 203 by a heat cut assembly 501. The transfer assembly 401 fits, by its own rotation, the gore piece 10 to the correct position on the incomplete panty-hose 7*a* held by the suction assembly 201 and the sliced fringe 5 is returned to the horizontal state by, e.g. application of pneumatic blow, in order to be superimposed upon the fringe of the gore piece 10 already placed in position on the second station II.

In the third station III, the suction assembly 201 revolves together with the incomplete panty-hose 7*a* and the gore piece 10 so that a sewing machine 601 seams the sliced fringe 5 of the incomplete panty-hose 7*a* with the fringe of the gore piece 10 in order to obtain a complete panty-hose 7.

In the fourth station IV, the complete panty-hose 7 is removed off the suction assembly 201 to be discharged outside the system by a removing assembly 701.

Detailed constructions of the above-described various assemblies are as follows.

(1) The carrier disc 104

Figure 5:
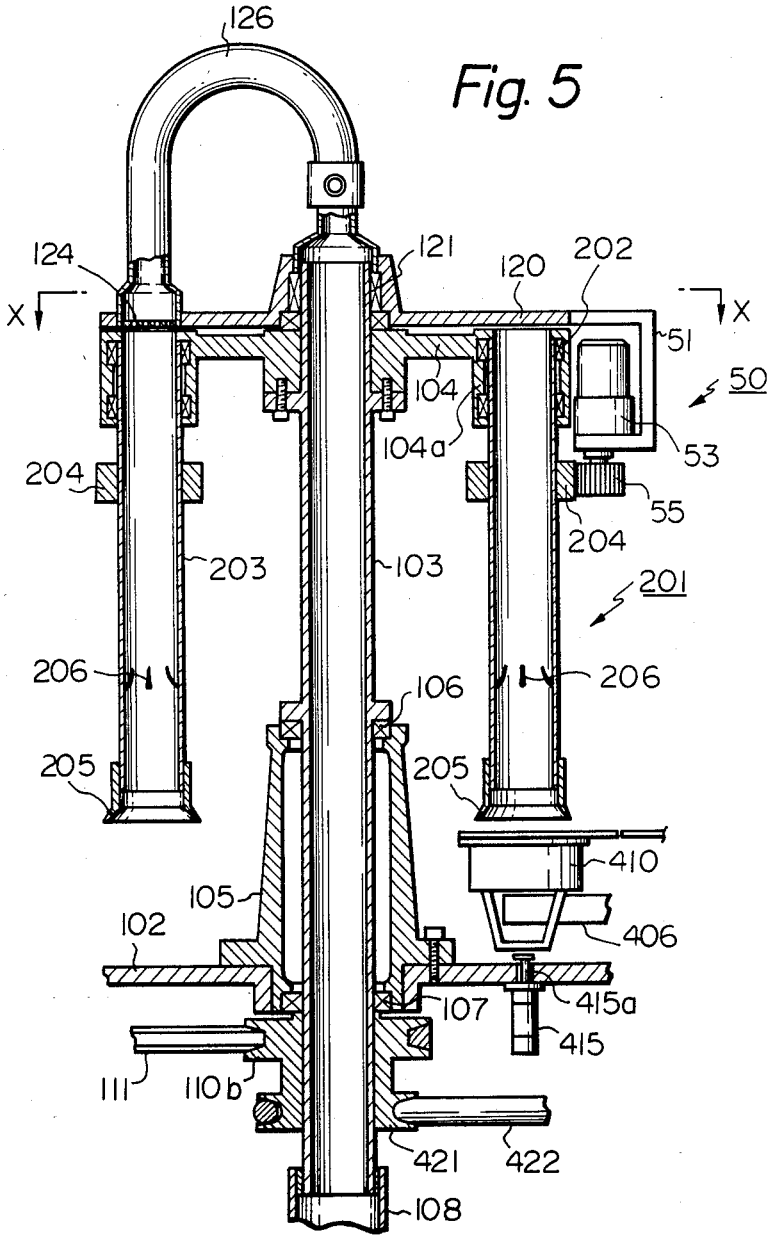
FIG. 5 is a side view, partly in section, of the suction assemblies and their related parts used for the seaming apparatus shown in FIG. 3.

As shown in FIGS. 3 and 5, the main shaft 103 is rotatably carried, via thrust bearings 106 and 107, by a cylindrical stand 105 fixed atop the operation table 102. The main shaft 103 is cylindrical in shape and its lower end is connected to an adequate suction source (not shown) by a suction pipe 108. The pneumatic suction is controlled by ordinary manual switching operation.

A drive motor 109 accompanying a known reduction gear mechanism is arranged under the operation table 102 and its output shaft carried a drive pulley 110*a* which is operationally coupled, via a drive belt 111, to a driven pulley 110*b* mounted to the main shaft 103. By properly controlling the operation of the drive motor 109, the main shaft 103 and the carrier disc 104 are driven for intermittent rotation, each movement covering 90 degrees center angle.

As a substitute for the above-described arrangement for the intermittent rotation, any known drive mechanism such as a geneva index unit is usable for the present invention. Further, a known timer or the like is usable for control of the drive motor 109.

(2) The suction assembly 201

As shown in FIGS. 3 and 5, each suction assembly 201 includes a vertical suction tube 203 which is rotatably carried at its top by a boss 104*a* on the carrier disc 104 by means of thrust bearings 202. The suction tube 203 is open at both longitudinal ends and a skirt-shaped bottom flange 205 is fixedly inserted over its bottom end. At a level near the top end, a gear 204 is fixedly inserted over the suction tube 203 for engagement with the later described suction tube driver assembly 50.

At least one hook 206 is fixed at its lower end to the inside wall of the suction tube 203, which is made of a flexible material such as a synthetic resin. The hook 206 blocks falling of the incomplete panty-hose 7*a* outside the suction tube 203 when the pneumatic suction is intercepted at the first station I. Preferably, three or more hooks 206 are arranged in the suction tube 203 for reliable holding of the incomplete panty-hose 7*a* within the suction tube 203.

A cover disc 120 is arranged on the carrier disc 104 whilst being rotatably inserted over the top end of the main shaft 203 via a thrust bearing 121. The diameter of the cover disc 120 is almost equal to that of the carrier disc 104. As later described in more detail, the cover disc 120 is coupled to the pedestal casing 101 by means of the removing assembly 701 and, consequently, held stationarily despite the rotation of the main shaft 103.

As shown in FIG. 6, circular holes 122 and 123 are formed through the cover disc 120 at positions corresponding to the first and fourth stations I and IV. The positions of these holes 122 and 123 are selected so that they correctly meet the top opening of a suction tube 203 when the latter is in these stations I and IV.

A perforated block disc 124 is arranged in the circular hole 122 in the first station I in an arrangement flush with the bottom face of the cover disc 120. The circular hole 122 is connected to the top opening of the main shaft 103 by means of a curved pipe 126. Thus, pneumatic suction acts on the suction tube 203 via the cylindrical main shaft 103, the curved pipe 126 and the perforated block disc 124.

(3) The suction tube driver assembly 50

As shwon in FIGS. 3 and 5, a drive motor 53 is fixed, by means of a bracket 51, to the cover disc 120 at a position corresponding to the third station III. A gear 55 fixed to its output shaft is engageable with the gear 204 on the suction tube 203 when the latter is at the third station III. As the drive motor 53 is activated, the suction tube 203 starts to rotate about its own axis.

(4) The gore piece feeder assembly 301 and the gore piece transfer assembly 401

Figure 7:
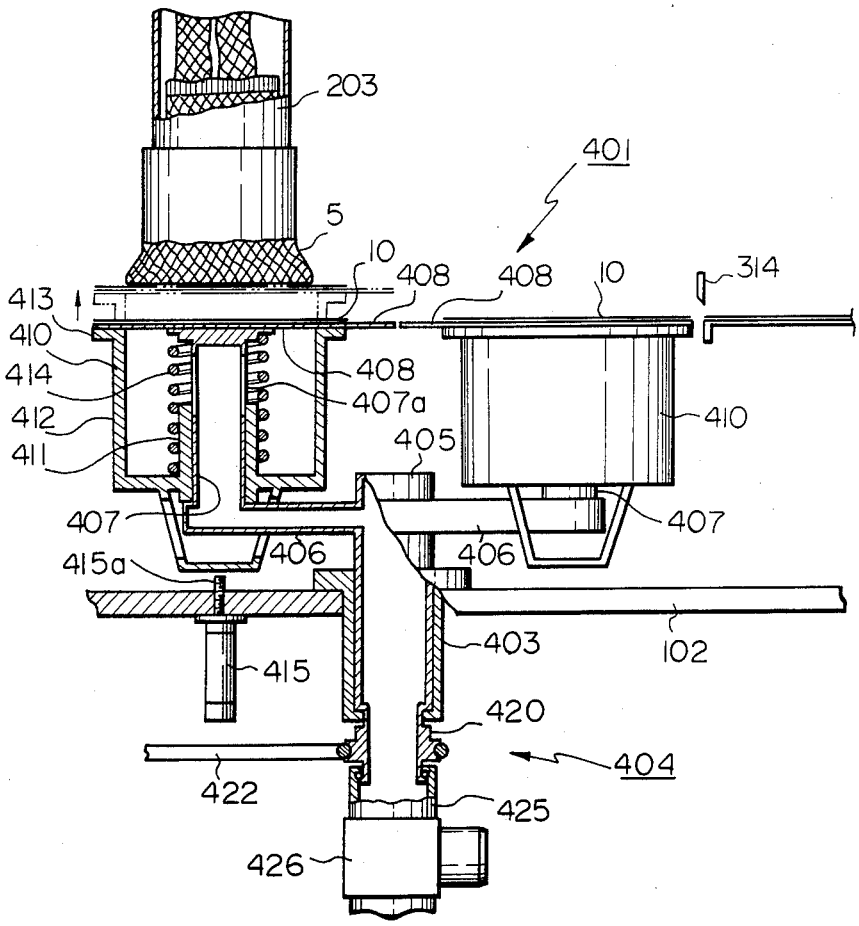
FIG. 7 is a side view, partly in section, of the transfer assembly and its related parts used for the seaming apparatus shown in FIG. 3.

The detailed constructions of the assemblies are shwon in FIGS. 3, 4 and 7.

In the second station II, a gore piece 10 cut into a prescribed shape is fed by the feeder assembly 301 to the transfer assembly 401 which in turn fits the gore piece 10 to the correct position on the incomplete panty-hose 7*a* held by the suction assembly 201 so that the sliced fringe 5 and the fringe of the gore piece are superimposed in a horizontal state.

As shown in FIGS. 3 and 4, the feeder assembly 301 includes a feed reel 303 of the gore piece band which is conveyed towards the transfer assembly 401 by means of feed rollers 306 and 307 via guide and dancer rollers 304 and 305.

A supporting stand 310 is arranged on the square section of the operation table 102 and bears a drive motor 311 which is operationally coupled to the reel 303 and the rollers 304, 306 and 307 by means of ordinary pulleys and a drive belt. Upon each intermittent rotation of the drive motor 311, the gore piece band is delivered from the reel 303 by a length corresponding to one gore piece 10. A pair of vertically shiftable cutters 312 and 313 are arranged at a position between the rollers 306 and 307 in order to cut out the side fringes of the gore piece band in a triangular shape during the dwell of the intermittent delivery of the band. Concurrently with this procedure, a cutter 314 arranged on th stand 310 in front of the feed roller 307 shifts downwards and forms a straight cut in the center of the band in order to form of gore piece 10 of a prescribed shape, e.g. a diamond shape.

The construction of the gore piece transfer assembly 401 will hereinafter be explained in more detail in reference to FIGS. 4, 7 and 9C. A cylindrical bracket 403 is fixed to a prescribed position on the operation table 102 and rotatably caries a drum assembly 404.

The drum assembly 404 includes a cylindrical support shaft 405 having a lower section rotatably inserted into the bracket 403, and a pair of hollow support arms 406 extending horizontally and in opposite directions from the support shaft 405 at a level above the operation table 102. Each support arm 406 carries at its outer end a cylindrical upright shaft 407 having a top flange. A horizontal semi-circular plate 408 is located on the top flange of each upright shaft 407. The pair of semi-circular plates 408 faces each other along their stright edges whilst leaving a slight gap. Each semi-circular plate 408 is provided with numerous suction holes 408*a* formed therethrough.

An inner cylinder 411 of a double drum 410 is inserted over each upright shaft 407 and a compression spring 414 is imposed between the bottom wall of its outer cylinder 412 and the lower face of the associated semi-circular plate 408 whilst coaxially surrounding the upright shaft 407. That is, the double drum 410 is elastically pressed towards the associated support arm 406. A flange 413 is formed atop the outer cylinder 412 and fixedly carries the assiciated seme-circular plate 408.

In the second station, a pneumatic cylinder 415 is fixed to the lower face of the operation table 102 and its piston rod 415*a* extends upwards slidably through the operation table 102 in order to face the lower face of the double drum 410. Consequently, as the piston rod 415*a* is driven for upward movement by the pneumatic cylinder 415, the double drum 410 is forced to move upwards over a prescribed distance whilst overcoming repulsion of the compression sping 414. The lifted position of the double drum 410 is shown with chain lines in FIG. 7.

Relationship in position between the pair of double drums 410 in the second station II is shown in FIG. 7. That is, the right side double drum 410 faces the downstream terminal of the gore piece feeder assembly 301 in order to receive a gore piece on its semi-circular plate from the feeder assembly. The left side double drum in the second station II is located in axial alignment with the suction tube 203 of the suction assembly 201 in that station. In this state, a slight gap is left between the semi-circular plate 408 and the lower end of the bottom flange 205 on the suction tube 203.

At a level below the cylindrical bracket 403, a pulley 402 is fixedly inserted over the support shaft 405 and operationally coupled to a pulley 421 on the main shaft 103 (see FIG. 3) by means of a drive belt 422. As the main shaft 103 is driven for rotation by the drive motor 109, the drum assembly 404 with the double drums 410 rotates about the axis of the support shaft 405 in a direction shown by an arrow in FIG. 4, i.e. counterclockwise. The ratio in diameter between the two pulleys 420 and 421 is designed 1:2 so that the drum assembly 404 completes a 180 degrees rotation upon 90 degrees rotation of the main shaft 103.

As the main shaft 103 rotates over 90 degrees, each suction assembly 201 travels from a station to an adjacent station and the pair of double drums 410 alternate in position in order to rest in the new positions. During the dwell, a gore piece 10 is passed to the right side double drum 410 by the feeder assembly 301 whereas the left side double drum 410 assigns a gore piece to the suction assembly 201 in second station II.

The lower end of the support shaft 405 is coupled in air-tight to a connection pipe 425 which is in turn connected to the suction pipe 8 (see FIG. 5) via a valve 426. The valve 426 takes the form of a normally closed valve which is made open only when the drum assembly 404 performs the 180 degrees rotation. This opening of the valve 426 allows application of pneumatic suction to the gore piece 10 on the associated semi-circular plate 408 via the connection pipe 425, the support arm 405, the support arm 407, a slit 407*a* in the upright shaft 407, the double drum 410 and the suction holes 408*a* of the semi-circular plate 408, thereby effectively blocking accidental falling of the gore piece during movement of the associated drum assembly 404.

As shown in FIG. 3, a flat guide plate 423 extends between the second and third stations II and III along the travelling path of the suction assemblies 201. The top face of this guide plate 423 is flush with those of the semi-circular plate 208 in the lifted position (see FIG. 7) and the sewing table in the third station III. As the suction assembly 201 travels from the second to the third station with the gore piece 10 passed by the feeder assembly 401, the gore piece 10 slides on and along the guide plate 423. Therefore, the top face of the guide plate 423 should preferably as smooth as possible. When necessary, any smoothing finish may be applied to its top face.

(5) Heat cut assembly 501

Concurrently with transfer of the gore piece at the second station II, cuts are formed in the sliced fringe 5 folded over the suction tube bottom flange 205 by heat cut. In advance to the subsequent seaming on the sewing machine 601, the sliced fringe 5 has to be returned to the horizontal state by means of, for example, air blow in order to be superimposed on the fringe of the gore piece 10 located on the sewing table. Presence of the above-described cuts enables easy and successful fattening of the sliced fringe 5. It is not always necessary to complete this flattening in the third station III. After the heat cut is complete, the pneumatic flattening may be carried out in the second station II also. It is only required that the sliced fringe 5 should be horizontally superimposed upon the fringe of the gore piece in advance to the seaming operation at the third station III.

The heat cut assembly 501 will now be explained in more detail whilst referring to FIGS. 3, 4, 12 and 13.

At a position facing the second station II, a bracket 503 is fixed to the operation table 102 and carries a pneumatic cylinder 505. A rack 507 is fixed at its one longitudinal end to the outer end a piston rod 505*a* of the cylinder 505. An arm 509 is fixed to the other end of the rack 507 and carries an electric heat cutter 511. The rack 507 is in engagement with a pinion 513 which in turn engages with a gear 519 on the opposite side of the rack 507. An arm 515 extends from the pinion 513 in a direction substantially normal to the longitudinal direction of the rack 507. Likewise, an arm 521 extends from the gear 519 in alignment with the arm 515. The arms 515 and 521 carry electric heat cutters 517 and 523 at their free ends.

Figure 12:
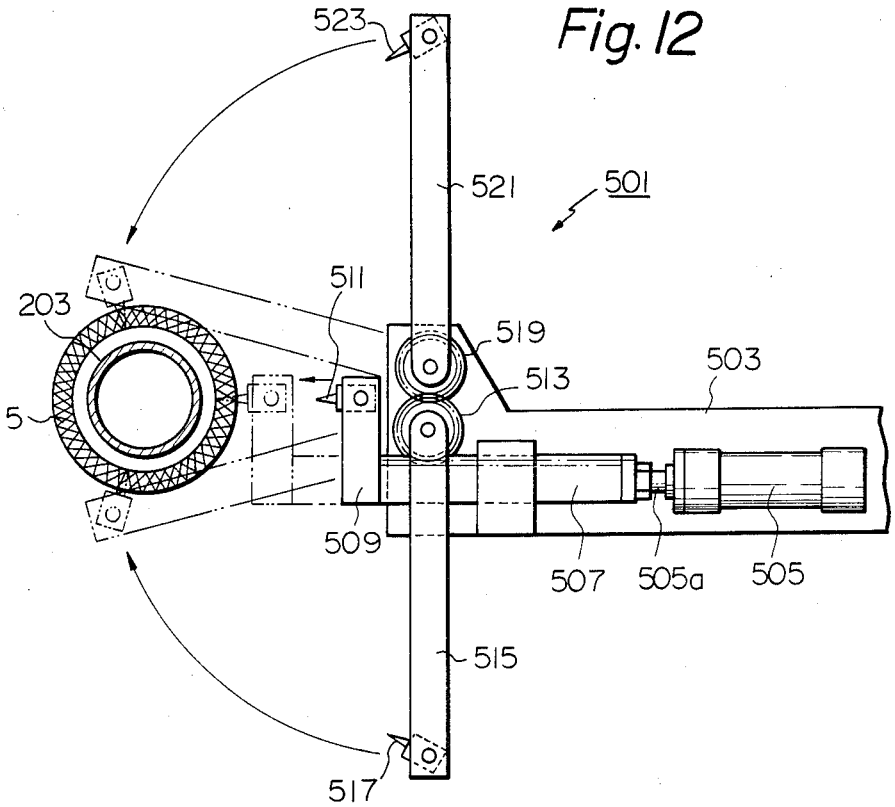
Figure 13:
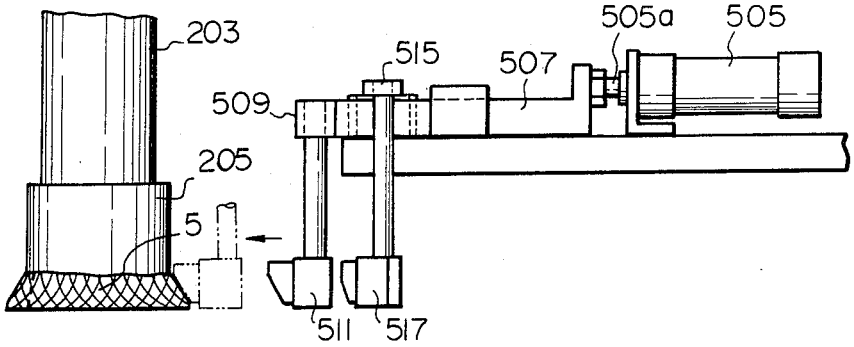

The arms and the cutters assume the inoperative position shown with solid lines in FIGS. 12 and 13 when the pneumatic cylinder 505 is inoperative. As the cylinder 505 operates, the piston rod 505*a* projects and the heat cutter 511 with the arm 509 moves towards the suction assembly 201 in the second station II and arrives at the operative position shown with chain lines. Concurrently, arms 515 and 521 sewing towards the suction assembly 201 with their heat cutters 517 and 523 in order to arrive at the operative positions shown with chain lines also. At the operative positions, the heat cutters 511, 517 and 523 touch the sliced fringe 5 on the suction tube bottom flange 205 in order to form cuts at about 120 degrees intervals. As the piston rod 505*a* receds into the pneumatic cylinder 505, arms and heat cutters all resume the inoperative positions. The number of the heat cutters, i.e. the number of cuts formed in the sliced fringe, is not limited to three. However, in consideration of simplicity in construction and easiness in flattening operation, it is advantageous to use three sets of heat cutters.

(6) A sliced fringe direction adjuster assembly 800

As described already, the transfer assembly 401 receives a gore piece from the feeder assembly in order to transfer it to the suction assembly 201 located at second station II so that the sliced fringe 5 of the incomplete panty-hose 7*a* is superimposed upon the fringe of the gore piece 10. For correct seaming on the sewing machine 601, the seaming line on the gore piece 10 should meet that on the sliced fringe 5 without any bias. In general on a gore piece 10 made of cotton or the like, its stretch is larger in the warp direction than in the weft direction. Therefore, it is advantageous that the warp direction on the gore piece 10 should meet that of the seaming line on the sliced fringe 5.

Figure 10:
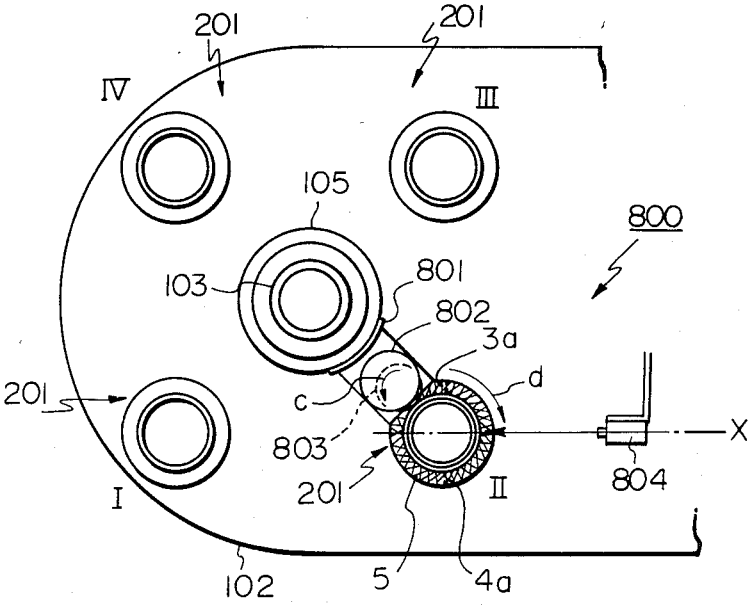
FIGS. 10 and 11 are top and side views of a modified embodiment of the transfer assembly shown in FIG. 7, and FIGS. 12 and 13 are plan and side views of the heat cut assembly used for the seaming assembly shown in FIG. 3.
Figure 11:
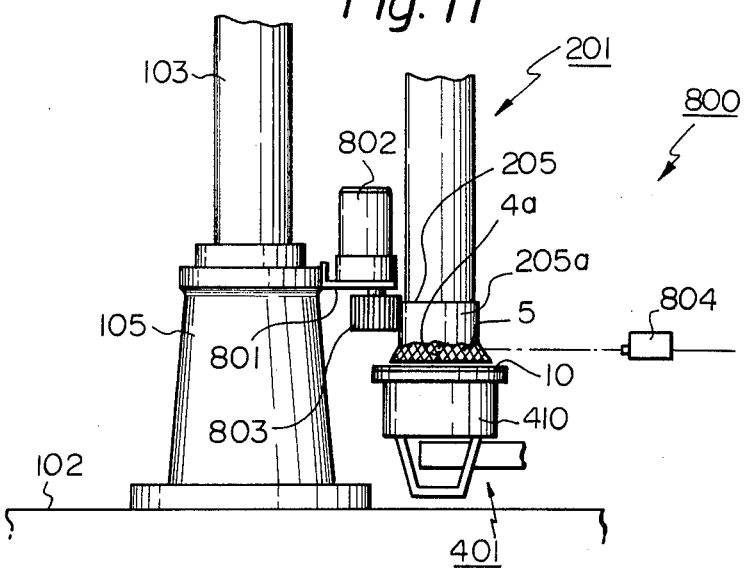

This adjustment is carried out by the direction adjuster assembly 800 shown in FIGS. 10 and 11.

A bracket 801 is mounted to the top end of the cylindrical stand 105 carries a drive motor 802 which is driven for rotation by an electric signal from a later described photoelectric sensor 804. A roller 803 is fixed to the output shaft of the drive motor 802 in pressure contact with the outer wall 205*a* of the bottom flange 205 on the suction assembly 201 located at the second station II. As the roller 803 rotates in the direction of an arrow "c", the flange 205 rotate in the direction of an opposite arrow "d" in FIG. 10 due to the above-described pressure contact.

The photoelectric sensor 804 is arranged at a proper position on a straight horizontal line passing through the center axis of the suction assembly 201 located in the second station II. The sensor 804 detects presence of the sliced fringe 5 and the seam lines 3*a* and 4*a* on the incomplete panty-hose 7*a* held on the suction assembly 205 in the second station II.

As the sensor 804 detects presence of the sliced fringe 5, its electric detection signal drives the motor 802 for rotation. The motor 802 ceases its rotation, however, as the sensor 804 detects presence of the seam lines 3*a* and 4*a*. In other words, the sensor 804 detects presence of the sliced fringe 5 when the seam lines 3*a* and 4*a* are off the straight line X and the motor 802 is driven for rotation. As a consequence, the roller 803 rotates in the direction "c" and the flange 205 in the direction "d". As the seam lines 3*a* and 4*a* meet the straight line X, the sensor 804 detects this end the motor 802 ceases its rotation. When the seam lines 3*a* and 4*a* are on the straight line X from the beginning, the motor 802 does not rotate at all. In either case, the seam lines 3*a* and 4*a* are registered at the straight line X by the sensor 804 before the sliced fringe 5 and the fringe of the gore piece 10 are superimposed.

(7) The sewing machine 601

The sewing machine 601 is arranged in the third station III in order to seam the sliced fringe 5 of the incomplete panty-hose 7*a* held by the suction assembly 201 with the fringe of the gore piece 10. The construction is shown in FIG. 8.

At the moment the suction assembly 201 with the incomplete panty-hose 7*a* and the gore piece 10 arrives at the third station III after its travel along the guide plate 423, the gore piece 10 is in the horizontal state but the sliced fringe 5 is folded over the suction tube bottom flange 205. Prior to starting of the seaming operation, the sliced fringe 5 needs to be returned to the horizontal state for snug superimposition with the fringe of the gore piece 10. This flattening is carried out on the sewing table 603.

One example of such flattening is carried out by an air ejection nozzle 604 arranged new the sewing machine 601 with its ejection mouth closely facing the outer wall of the suction tube bottom flange 205. Air blow by the nozzle 604 flattens the sliced fringe 5 on the gore piece 10.

Another example of such flattening is carried out by an air suction nozzle 605 located at an upstream position of a sewing needle 601*a* on the sewing machine 601. Air suction by the nozzle 605 flattens the sliced fringe 5 on the gore piece 10.

These air nozzles 604 and 605 may be used in combination.

It is also feasible to arrange these air nozzles 604 and 605 at the second station II in order to practice the flattening of the sliced fringe just after transfer of the gore piece 10 to the suction assembly 201. In this case, however, there is a likelihood that the once flattened sliced fringe 5 may loose its correctly superimposed state due to any unexpected shock to be caused during its travel to the third station III with the suction assembly 201. In order to avoid such a trouble, it is rather advantageous to carry out the flattening of the sliced fringe 5 at the third station III.

(8) The removing assembly 701

The complete panty-hose 7 formed at the third station III is removed off the suction assembly 201 at the fourth station IV in order to be discharged outside the system.

The removing assembly 701 is shown in detail in FIG. 3.

One end of a delivery pipe 703 is coupled to the circular hole 123 (see FIG. 6) in the cover disc 120. The other end of the delivery pipe 703 is provided with a delivery mouth 704. A pair of vertically spaced brackets 705 are disposed to the cover disc 120 and the operation table 102 in axial alignment, respectively, in order to hold a suction pipe 706 vertically. This connection holds the cover disc 120 inmovable with respect to the main shaft 103 which rotates intermittenlly. The upstream end of this suction pipe 706 is coupled to the suction tube 108 with the downstream end to the delivery mouth 704.

Thus, penumatic suction acts on the complete panty-hose 7 within the suction tube 201 via the suction pipes 108 and 706, the delivery mouth 704, the delivery pipe 703 and the circular hole 123. As a consequence the complete panty-hose 7 is discharged outside the system via the circular hole 123, the delivery pipe 703 and the delivery mouth 704.

Operation of the automatic seaming apparatus in accordance with the present invention and equipped with the above-described assemblies is as hereinafter described, reference being made to FIGS. 9A through 9E.

Figure 9A:
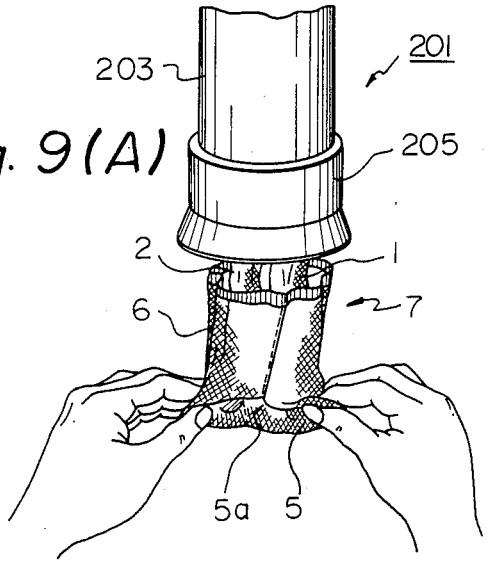
FIG. 9E is a plan view of the panty section of the panty-hose produced in accordance with the seaming method in accordance with the present invention.
Figure 9B:
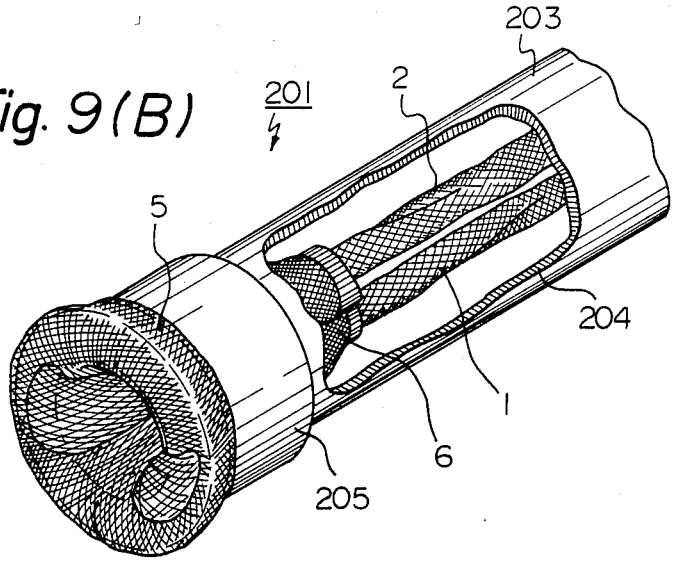

In the first station I, pneumatic suction acts on a suction assembly 201 by manual switching so that, as shown in FIG. 9A, the leg sections of an imcomplete panty-hose 7*a* are sucked into the suction tube 203 and the inside thigh sliced fringe 5 is manually folded over the bottom flange 205. Even after the pneumatic suction is intercepted, the incomplete panty-hose 7*a* is held on the suction assembly 201 by the hooks 206 (see FIG. 2). The suction assembly 201 then travels towards the second station II whilst carrying the incomplete panty-hose 7*a* as shown in FIG. 9B.

In the second station II, the feeder assembly 301 passes a sheet of gore piece 10 cut into a prescribed shape onto one double drum 410 of the transfer assembly 401. Thereafter, the valve 426 is rendered open in order to suck the gore piece to the top face of the associated semi-circular plate 408. In synchronism with the travel of the suction assembly 201 to the second station II, the double drum 410 revolves about the axis of the support shaft 405 over 180 degrees and is registered at a position below and in axial alignment with the suction assembly 201 arrived at the second station II.

Further, by operation of the direction adjuster assembly 800, the angular position of the sliced fringe 5 on the bottom flange 205 is adjusted with respect to the gore piece 10.

Figure 9C:
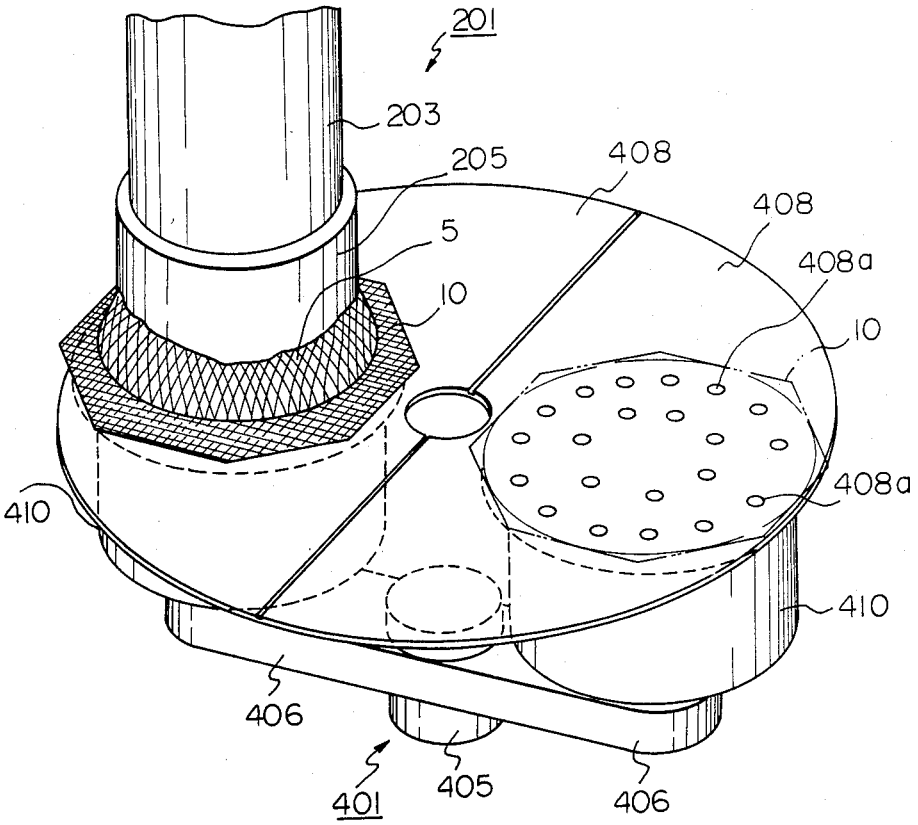

At this moment, the valve 426 is closed in order to cancel the pneumatic suction working on the gore piece 10 on the semi-circular plate 408 and the pneumatic cylinder 415 starts to lift the double drum 410, thereby placing the gore piece 10 on the semi-circular place 408 into pressure contact with the bottom of the sliced fringe 5 on the flange 205 as shown in FIG. 9C.

Concurrently with this procedure, the heat cut assembly 501 forms cuts in the sliced fringe 5.

As these operations are complete, the suction assembly 201 with the incomplete panty-hose 7*a* travels towards the third station III. The gore piece 10 on the semi-circular plate 408 in the lifted position slides towards the sewing table 603 along the guide plate 423 due to the above-described pressure contact.

Figure 9D:
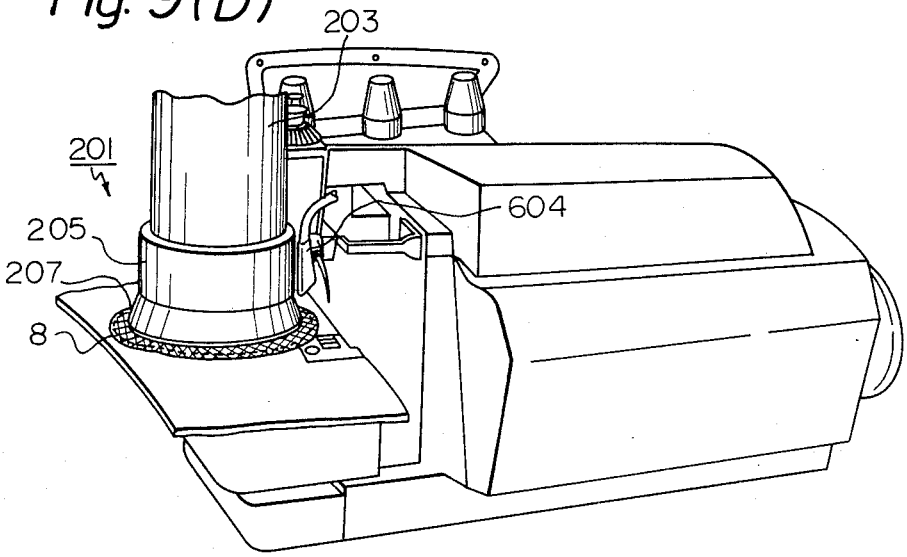
Figure 9E:
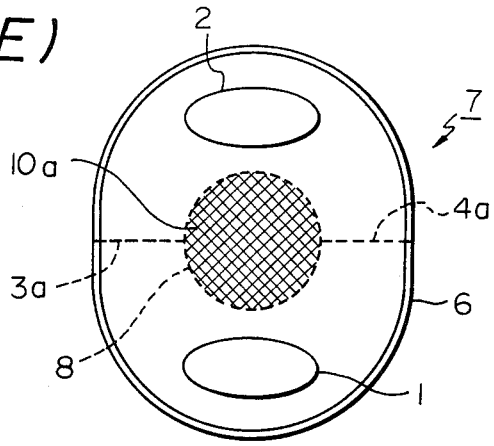

In the third station III, the sliced fringe 5 is turned back to the horizontal state by operation of the air ejection nozzle 604 and/or the air suction nozzle 605 in order to be superimposed on the fringe of the gore piece 10. At this moment, the suction tube driver assembly 50 operates to rotate the suction tube 203 with the incomplete panty-hose 7*a* and the gore piece 10 over 360 degrees so that the sewing machine 601 seams the sliced fringe 5 together with the fringe of the gore piece 10. This procedure is shown in FIG. 9D. Concurrently with this seaming, the surplus sections of the sliced fringe 5 and the gore piece 10 are cut off and a complete panty-hose 7 such as shown in FIG. 9E is obtained which includes an almost round gore 10*a* seamed to its thigh section along the seam line 8.

As the seaming is complete, the suction assembly 201 travels towards the fourth station IV whilst carrying the complete panty-hose 7 inside. The removing assembly 701 thereupon operates to remove the panty-hose 7 off the suction assembly 201 and discharge outside the system.

In accordance with the present invention almost all operations are carried out quite automatically except for the initial manual attachiment of the incomplete panty-hose to the suction assembly in the first station. This naturally results in remarkable saving in labour, high production efficiency and low production cost.

Operations done by the automatic assemblies assures production of panty-hoses of uniform quality and shape.

The limited application of pneumatic suction only in the first station for holding of the incomplete panty-hose results in reduced power consumption and simple piping for the pneumatic system.

As the suction assemblies travel along a circular endless path, the apparatus is very compact in construction and less space is necessary for its installation.

I claim:

1. Automatic seaming apparatus for gored panty-hoses comprising a horizontal operation table having at least four separate operation stations arranged along a given circulating path of travel at substantially equal intervals, at least four suction assemblies arranged over said operation table, and each adapted for holding an incomplete panty-hose, each including a vertical suction tube provided with a bottom flange and at least one inner hook, means for concurrently driving said four suction assemblies for travel from station to station along said path of travel in an intermittent fashion with dwells so that each said suction assembly rests at any station during said dwells, a gore piece feeder assembly arranged facing a second station and adapted for sequentially feeding gore pieces of a prescribed pattern, one at a time, in an intermittent fashion, a gore piece transfer assembly interposed between said second station and said feeder assembly and adapted for transferring, in a horizontal state, each said gore piece fed by said feeder assembly to each said suction assembly located at said second station during each said dwell, a heat cut assembly arranged facing said second station and adapted for forming at least one longitudinal cut in the sliced fringe of each said incomplete panty-hose held by said suction assembly, means for flattening said sliced fringe of said incomplete panty-hose into a superimposed state with the fringe of said gore piece, a flat guide plate extending between said second and a third station and flush with the bottom face of said gore piece superimposed with said fringe of said gore piece, a suction tube driver assembly arranged in said third station and adapted for driving said suction tube of said suction assembly in said third station for a 360 degrees rotation, a sewing machine arranged in said third station, provided with a sewing table flush with said guide plate, and adapted for seaming said two superimposed fringes together during said 360 degrees rotation in order to form a completed gored panty-hose during each said dwell, a removing assembly arranged facing a fourth station and adapted for removing, by means of pneumatic suction, said complete gored panty-hose off said suction assembly located at said fourth station, and a pneumatic suction source connected to said transfer assembly, removing assembly and each said suction assembly located at said first station.

2. Automatic seaming apparatus as claimed in claim 1 in which said operation table takes the form of a round table having said circulating path of travel along its periphery, said driving means includes a vertical cylindrical main shaft which is axially rotatable in an intermittent fashion such that each rotation covers 90 degrees, and a horizontal carrier disc mounted atop said main shaft, and said four suction assemblies are disposed to the bottom of said disc at equal intervals along its periphery.

3. Automatic seaming apparatus as claimed in claim 1 in which the interior of each said suction assembly is connected to the suction terminal of said suction source via a manually shiftable valve and said main shaft.

4. Automatic seaming apparatus as claimed in claim 1 in which said gore piece feeder assembly includes a feed reel of a gore piece material band, means for delivering said gore piece band from said feed reel in an intermittent fashion over a length corresponding to each said gore piece at a time, a pair of cutters arranged downstreamly of said feed reel and adapted for deliniating each delivered section of said gore piece band, and a cutter arranged downstreamly of said pair of cutters and adapted for cutting each said delivered section into each said gore piece.

5. Automatic seaming apparatus as claimed in claim 1 in which said gore piece transfer assembly includes a vertical, cylindrical, center support shaft axially rotatable in an intermitted fashion such that each rotation covers 180 degrees, a pair of double drums held by said support shaft at opposite diametric positions, the interior of each said double drum being connected to the suction terminal of said suction source via said support shaft, a perforated semi-circular plate closing the top opening of each said double drum and having a top face flush with that of said guide plate, means for elastically pushing said drum downwards, and means for thrusting up said drum against the pressure by said elastic pushing means to an extent such that a gore piece placed on said semi-circular plated, is placed in pressure contact with said sliced fringe of said incomplete panty-hose held by said suction assembly.

6. Automatic seaming apparatus as claimed in claim 1 in which said heat cut assembly includes at least one heat cutter, at least one movable arm holding, at its free end, said heat cutter, and means for driving said arm for movement between operative and in operative positions so that said heat cutter contacts, in said operative position, said sliced fringe of said incomplete panty-hose held by said suction assembly.

7. Automatic seaming apparatus as claimed in claim 1 in which said flatterning means includes at least one of an air ejection nozzle and an air suction nozzle closely facing said sliced fringe of said incomplete panty-hose located at said third section.

8. Automatic seaming apparatus as claimed in claim 1 in which said suction tube driven assembly includes a gear fixedly inserted over said suction tube of each said suction assembly, and a drive motor arranged in said third station and provided, on its output shaft, with a gear in engagement with said gear on said suction tube.

9. Automatic seaming apparatus as claimed in claim 1 further comprising means arranged facing said second station and for detecting, in photoelectric manner, whether or not seam lines on either sides of said sliced fringe of said incomplete panty-hose held by said suction assembly are in correct positions, said suction tube of said suction assembly being rotated by said detecting means until said seam lines are registered at said correct positions.

10. Automatic seaming apparatus as claimed in claim 1 in which said removing assembly includes a delivery pipe connectable at its one end to the top opening of each said suction assembly located at said fourth section, a delivery mouth coupled to the other end of said delivery pipe, and a suction pipe coupled at its one end to said delivery mouth and at its the other end to the suction terminal of said suction source.

11. Automatic seaming apparatus for gored panty-hoses comprising a horizontal operation table having at least first, second, third and fourth separate operation stations arranged along a prescribed path of travel at predetermined intervals, at least four suction assemblies arranged over said operation table for each holding an incomplete panty-hose having a sliced fringe, each of said suction assemblies including a suction tube provided with a bottom flange, driving means for concurrently driving said suction assemblies from operation station to operation station along said path in an intermittent manner and having common dwells whereby each said suction assembly remains at a respective one of said stations during said dwells, a gore piece feeder assembly arranged facing said second station for sequentially feeding, in an intermittent manner, gore pieces of a prescribed pattern having a fringe, a gore piece transfer assembly interposed between said second station and said feeder assembly for horizontally transferring each said gore piece fed by said feeder assembly to each said suction assembly located at said second station during each said dwell, a cutting assembly arranged facing said second station for forming at least one longitudinal cut in said sliced fringe of each said incomplete panty-hose held by said suction assembly, flattening means for flattening said sliced fringe of said incomplete panty-hose into a superimposed relationship with said fringe of said gore piece, a suction tube driver assembly arranged in said third station for rotating said suction tube thereat through 360 degrees, seaming means arranged in said third station for seaming together the superimposed fringes of said gore piece and said sliced fringe during said 360 degrees rotation of said suction tube within said third station in order to form a completed gored panty-hose during each said dwell, and a removing assembly arranged facing said fourth station for removing said completed gored panty-hose from said suction assembly located at said fourth station.

* * * * *